United States Patent [19]

Azzara

[11] 4,131,993

[45] Jan. 2, 1979

[54] MEANS FOR ENGAGING A SLIDER AUTOMATICALLY ON A SLIDE FASTENER CHAIN

[75] Inventor: Anthony A. Azzara, Brooklyn, N.Y.

[73] Assignee: Bruning Brothers Company, Inc., Commack, N.Y.

[21] Appl. No.: 826,728

[22] Filed: Aug. 22, 1977

[51] Int. Cl.[2] ..... B29D 5/00

[52] U.S. Cl. ..... 29/768

[58] Field of Search ..... 29/408, 768, 809, 33.2

[56] References Cited

U.S. PATENT DOCUMENTS

| | | | |
|---|---|---|---|
| 3,127,670 | 4/1964 | Bruning | 29/408 |
| 3,530,563 | 9/1970 | Maeda | 29/768 X |
| 3,663,000 | 5/1972 | Perlman | 29/768 X |
| 3,701,192 | 10/1972 | Laguerre | 29/768 |
| 3,714,698 | 2/1973 | Fukuroi | 29/408 |
| 3,792,521 | 2/1974 | Kawakami | 29/768 X |
| 4,049,155 | 9/1977 | Kawakami | 29/768 X |

*Primary Examiner*—Victor A. DiPalma
*Attorney, Agent, or Firm*—Edward H. Loveman

[57] ABSTRACT

A mechanism for automatically engaging a slider upon a pair of slide fastener chains having teeth, includes a curved track which is supplied with sliders from a hopper. One slider at a time moves to a position in front of a carrier on which is mounted a pivotable lever. The first slider from the hopper is held in position by a horizontal retractable pin extending to the track. The lever has a foot which clamps the end slider from the hopper. Jaws carrying a pair of slide fastener chains move to the clamped slider which is moved by the carrier toward the jaws. The adjacent end of each chain is inserted into the body of the clamped slider as the carrier moves forwardly. The carrier continues to move forwardly with the lever and clamped slider causing the teeth of the chains to close. The jaws and lever then release the new assembly of slider and two engaged chains, and other jaws grasp the new slide fastener assembly and move it to another processing station.

10 Claims, 13 Drawing Figures

MEANS FOR ENGAGING A SLIDER AUTOMATICALLY ON A SLIDE FASTENER CHAIN

This invention relates to the art of zippers and more particularly concerns a method and means for automatically engaging a slider upon two chains of slide fastener teeth.

Heretofore in the manufacture of slide fastener or zipper assemblies, the operation of engaging sliders with tapes carrying chains of teeth has been done manually. In large scale manufacture of slide fasteners, the automated fabrication procedure has been slowed and interrupted by the necessity of manually engaging each slider with a pair of tapes carrying chains of teeth. The present invention is directed at providing a method and means for automating this prior hand assembly operation.

According to the invention, a pair of endless tapes each carrying a chain of zipper teeth is cut into short strips of predetermined length. Terminal tips are secured to one end of each short strip and are then transferred in pairs to pairs of jaws which hold the terminals in closely spaced coplanar disposition. A plurality of preassembled conventional sliders are fed down a vertically inclined track or chute which is vibrated to keep the sliders moving therealong. At the bottom of the track is a horizontal track section where a spring biased stop pin supports the end slider. As the jaws holding the two chains approach the end slider, a foot of a hydraulically pivoted lever supported by a movable carriage engages and clamps the body of the end slider while the stop pin is withdrawn. The lever is then moved forwardly by the moving carriage, with the foot of the lever clamping the end slider to the carriage while a pivotable cam operated stop prevents the other sliders from coming off the track. The carriage moves toward the terminal tips of the two chains. The two terminal tips of the respective chains of teeth are inserted into respective channels in the slider body as the carriage advances. The carriage continues to advance while the respective teeth of the two chains engage as they pass through the slider body. The carriage advances a predetermined distance, where the first jaws release the joined chains and a second set of jaws engages the joined chains. The foot is pivoted to release the clamped slider, and the carriage retracts. The second jaws then transfer the zipper assembly of slider and joined chains to another station where a box-like clip is mounted over the terminal tips. As the carriage retracts to its original position, the stop bar lifts and the end slider moves laterally in front of the carriage where the pin is engaged by the spring biased pin to start another cycle which is then repeated as described above.

It is therefore a principal object of the present invention to provide means for automatically and repetitively engaging sliders with two chains of teeth on zipper tapes.

Another object of the present invention is to provide a new method for automatically and cyclically assembling a slider of a slide fastener with two zipper chains.

These and other objects and many of the attendant advantages of this invention will be readily appreciated as the same becomes better understood by reference to the following detailed description when considered in connection with the accompanying drawings in which.

Figure 1:
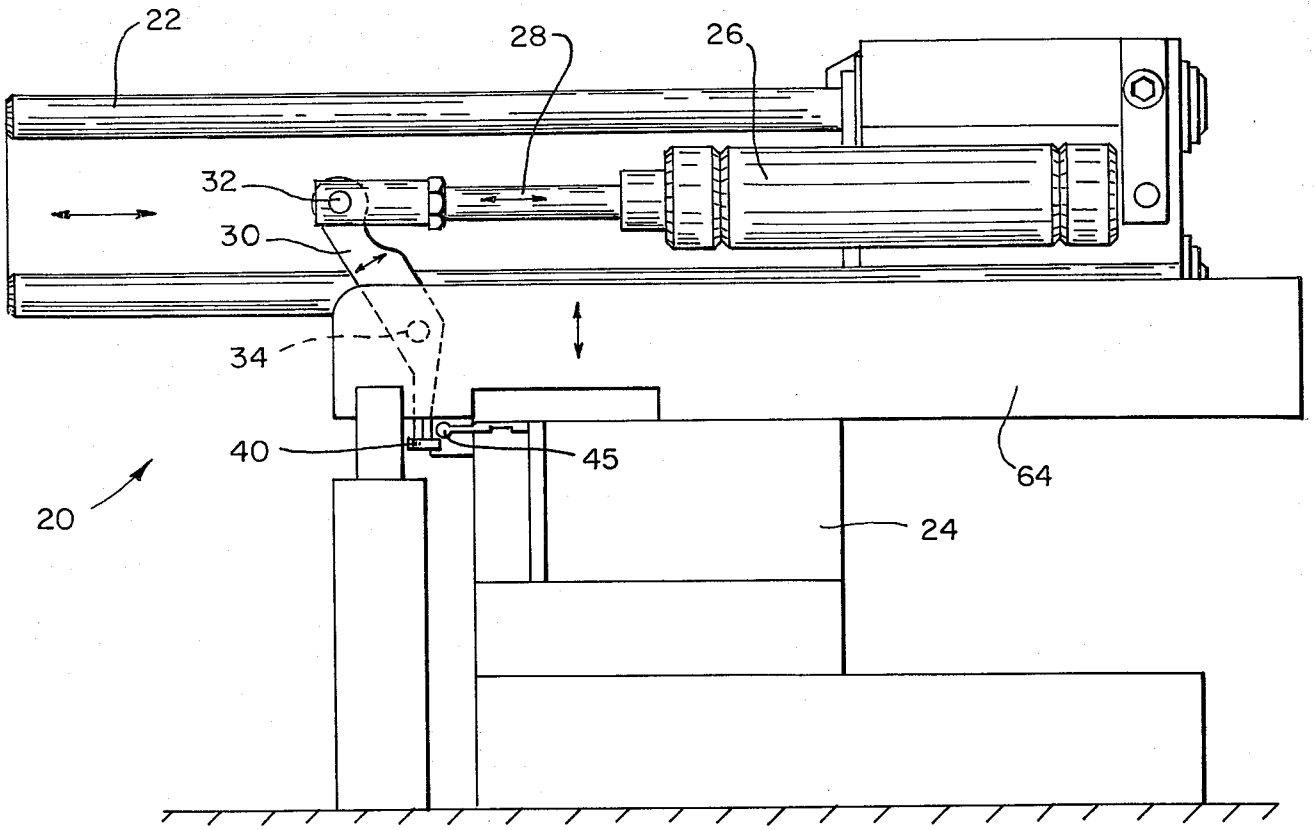
FIG. 1 is a side elevational view of a machine mechanism embodying the present invention.

Referring now to the drawings wherein like reference characters designate like or corresponding parts throughout, there is illustrated in FIG. 1, parts of a machine mechanism generally designated as reference numeral 20 having a sliding carriage 22 slidably mounted on a base block 24. Mounted in axially horizontal position on the carriage 22 is a hydraulic motor cylinder 26 having a horizontally movable piston shaft 28 carrying a lever 30. The upper end of the lever 30 is pivotally secured to the shaft 28 by a pin 32 and an intermediate point is pivoted on another pin 34. The pin 34 is mounted on the carriage 22, which is moved back and forth horizontally by a hydraulically actuated motor 38, shown diagrammatically in FIG. 3. At the bottom end of the lever 30 is a foot 40 which cooperates with a guide 43 and an anvil 42 at the front of the carriage to hold a zipper slider 44; see FIGS. 5 and 10.

Figure 2:
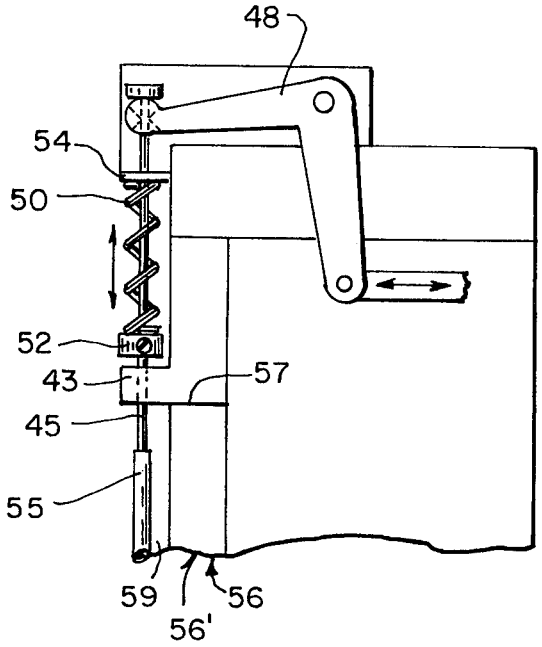
FIG. 2 is a fragmentary plan view of a pin actuating mechanism.

Spaced laterally from the carriage 22 is a horizontally movable spring biased pin 45; (see FIGS. 2, 3, and 4) which moves axially in a path across to the vertical plane of the lever 30 and is operatively connected to a hydraulic motor 46 via a linkage 48. A coil spring 50 on the pin 45 is mounted between a collar 52 on the pin 45 and a stationary bracket 54. The motor 46 may retract the pin, whereas the spring 50 will extend the pin transversely of the lever 30.

Figure 4:
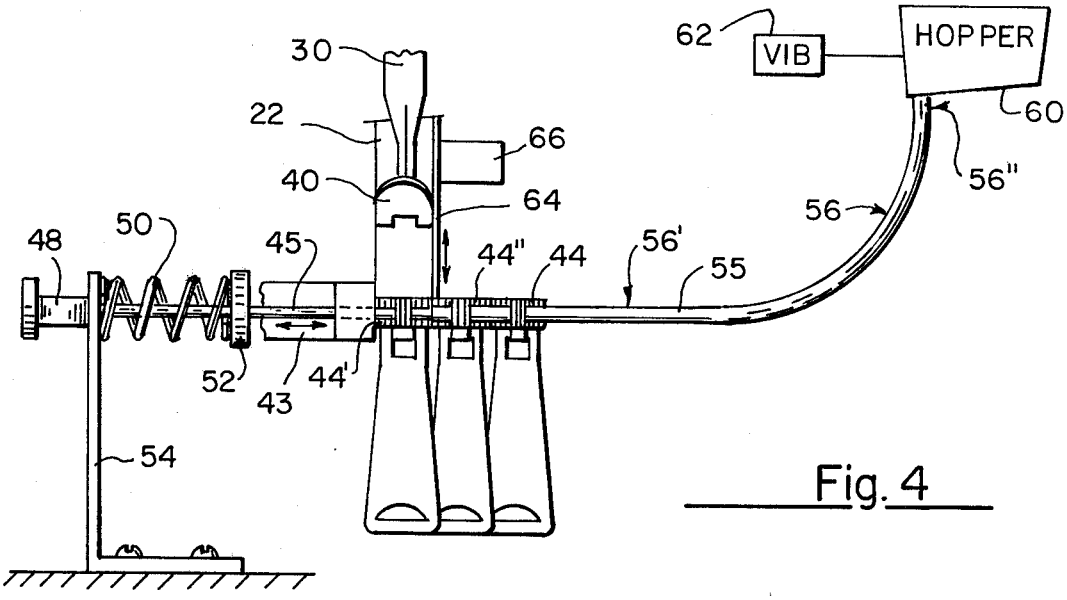
FIG. 4 is a diagrammatic front view of the parts of FIG. 3.
Figure 5:
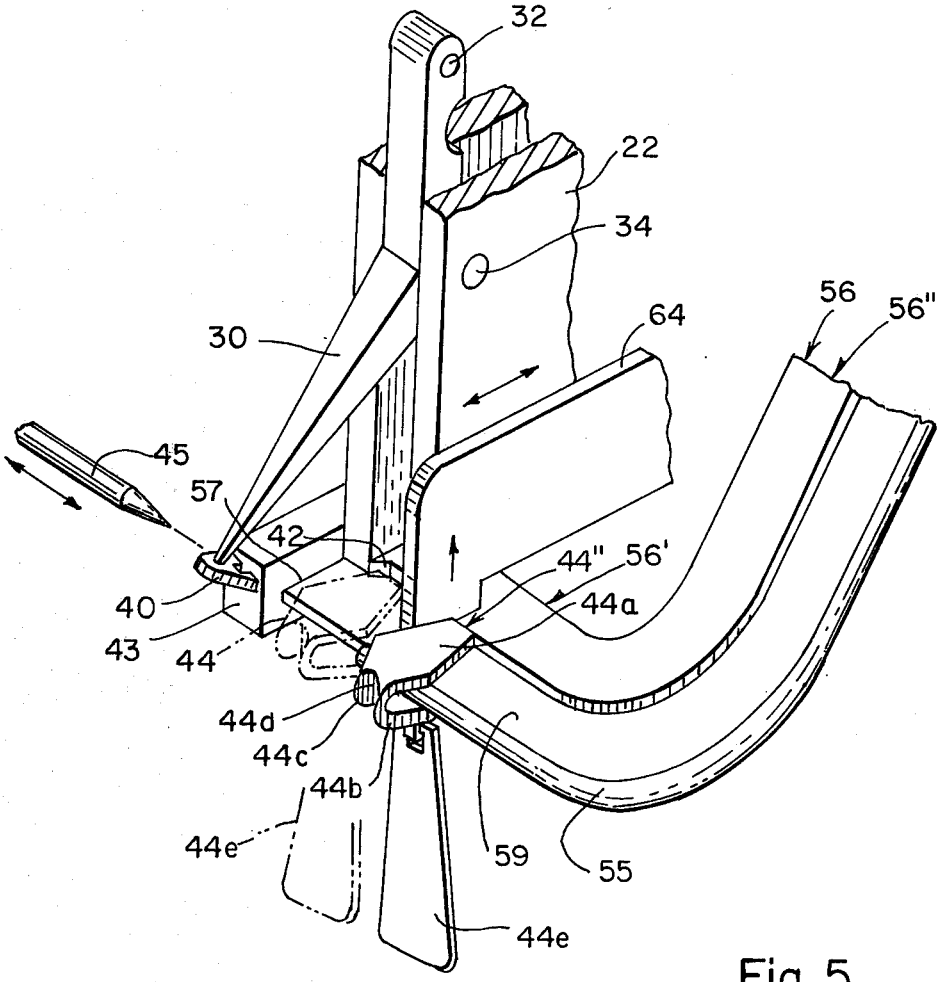
FIG. 5 is an enlarged fragmentary perspective view of parts of the mechanism at the beginning of the cycle as shown in FIGS. 3 and 4.
Figure 5A:
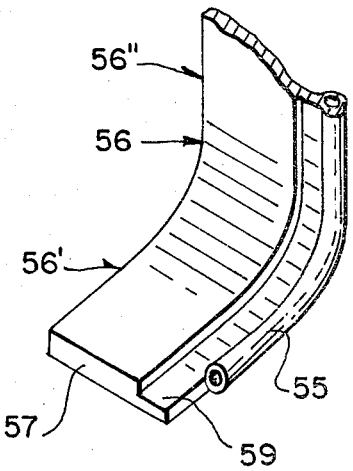
FIG. 5A is a fragmentary perspective view of an end portion of the track which carries the sliders.

Axially aligned with the pin 45 on the other side of the lever 30 is a tube 55 secured to the edge of a horizontal section 56′ of a chute or track 56. The tube 55 terminates short of an end 57 of the track 56 a distance equal to the width of the slider 44. The track 56 is curved upwardly as shown in FIGS. 5 and 5A. The vertical section 56″ of the track terminates at a hopper 60 (see FIG. 4) connected to a vibrator motor 62. The hopper 60 receives a multiplicity of the sliders 44 which are conveyed down the track 56, which has a ledge 59 extending the length thereof and serves to guide the sliders 44 down the track 56. The sliders 44 are stopped by the spring biased pin 45 which is extended at the start of a cycle operation as shown in FIG. 5. The end slider 44 is engaged on the pin 45 whose pointed end extends into the tube 55. The end slider 44' is located in front of the anvil 42 and is off the track 56, being supported by the pin 45. The next slider 44" is engaged on the track 56 just laterally of the end of the tube 55 as shown in FIG. 5. A cam operated stop bar 64 is lowered as the carriage 22 moves away from the base block 24 to prevent the slider 44" from moving laterally. The pressure of the line of sliders 44 tends to urge the first sliders to the left as illustrated in FIGS. 4 and 5. The vibrator 62 prevents jamming of the sliders 44 on the track 56 and keeps the track 56 loaded with the sliders 44. It will be noted that the sliders 44 are of conventional type, with a generally U-shaped body having upper and lower walls **44*a*, 44*b*, respectively, and a vertical bight 44*c* formed with a notch 44*d*. The sliders 44 are oriented on track 56 so that this notch faces forwardly; see FIG. 5. The handles 44*e* of the sliders 44** hang downwardly.

Figure 3:
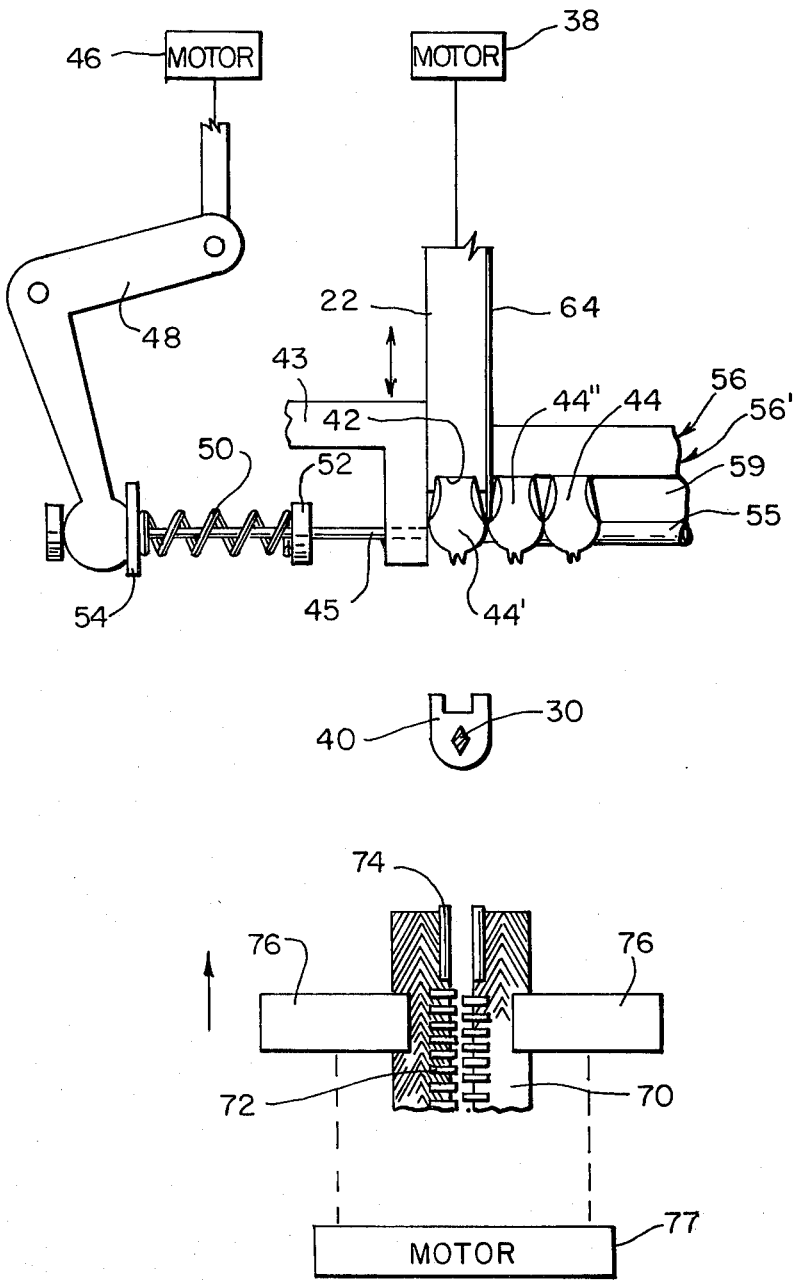
FIG. 3 is a diagrammatic plan view of parts of the mechanism at the beginning of a cycle for engaging a slider with ends of two slide fastener chains.
Figure 6:
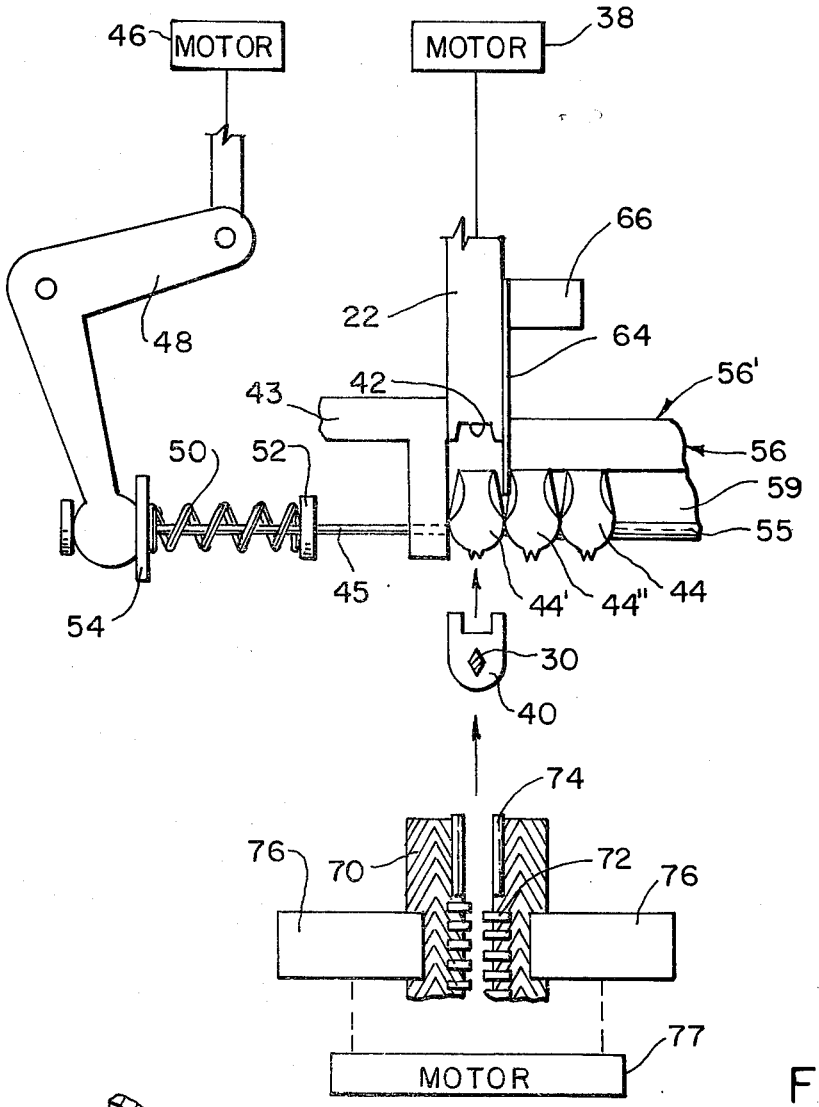
FIG. 6 is a diagrammatic plan view similar to FIG. 3 but showing the parts at a second stage of the cycle.
Figure 10:
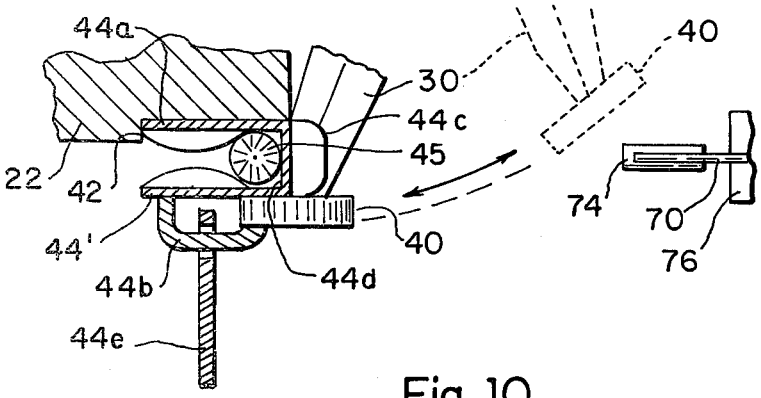
FIG. 10 is an enlarged fragmentary sectional view of a slider held in position by the pivotable foot and carriage of the mechanism at the stage of the cycle shown in FIGS. 8 and 9.
Figure 7:
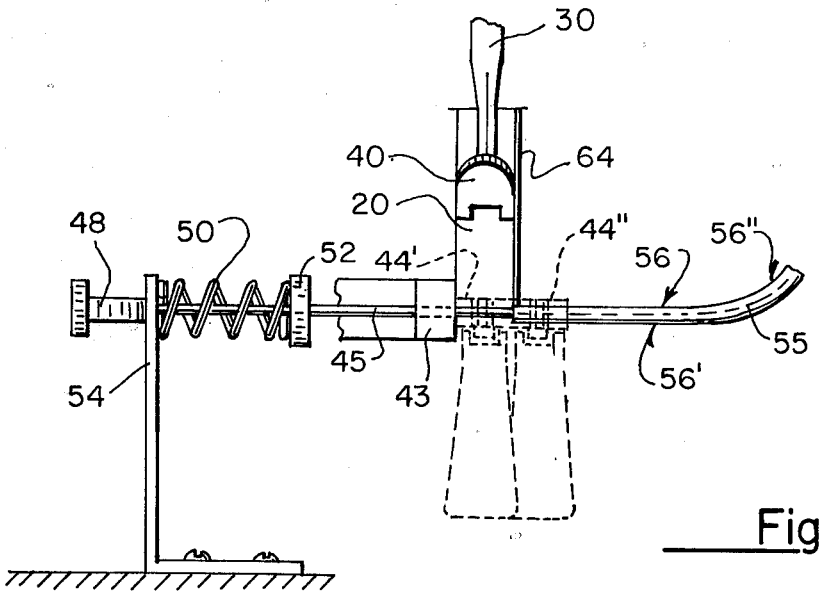
FIG. 7 is a diagrammatic front view similar to FIG. 4, but showing the parts at the second stage illustrated in FIG. 6.
Figure 8:
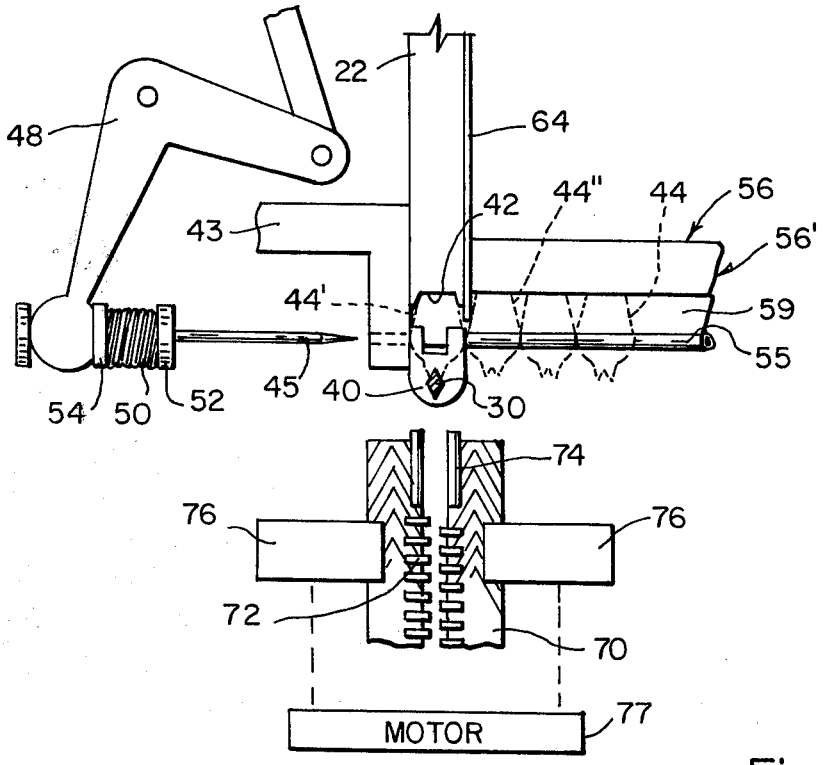
FIGS. 8 and 9 are diagrammatic plan and front views respectively showing the parts at a third stage of the cycle.
Figure 9:
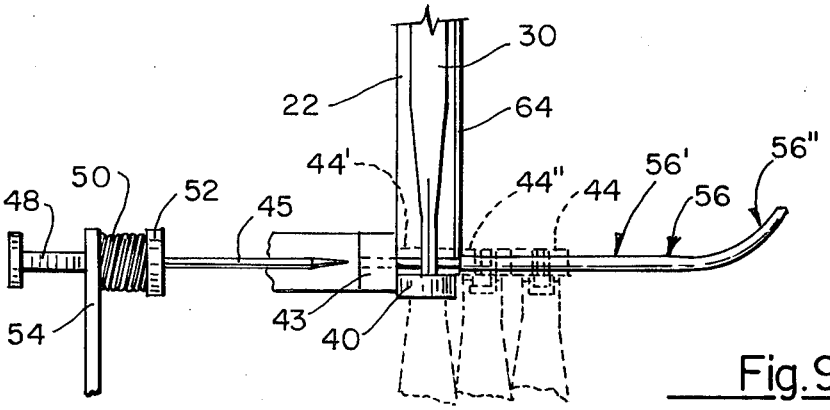

The mechanism operates to thread the end slider 44' upon a pair of conventional slide fastener chains 70 having conventional teeth 72. The chains 70 are cut into predetermined lengths from a supply roll of slide fastener chains (not shown). A terminal tip 74 is then secured to one end of each short length of chain 70. In the operation cycle of the mechanism, one pair of short chains 70 is grasped by one pair of spaced jaws 76 operatively driven by a motor 77. The chains 70 are held with ends in coplanar slightly spaced position as shown in FIG. 3. The terminal tips 74 are aligned with opposite sides of the lever foot 40. FIG. 4 shows the initial extended position of pin 45 with its end in tube 55. The slider motor 26 drives shaft 28 forwardly such that lever 30 pivots around pin 34 whereby the foot 40 is advanced to engage the back or bight **44*c* of the end slider 44' on the pin 44' (FIGS. 6, 7 and 10). The upper wall 44*a* of the slider 44 is engaged in the anvil 42. The motor 46 then operates to retract the pin 45 against the bias of the spring 50 (FIGS. 8, 9). As the carriage 22 moves forwardly away from slider track 56, the cam operated stop bar 64 engages and prevents the next slider 44" from falling off the track section 56'. The jaw 76 moves the chains 70 toward the foot 40 which is simultaneously moving thereto with the clamped slider 44'. The terminal tips 74 enter the slider 44' on opposite sides of the foot 40**.

Figure 11:
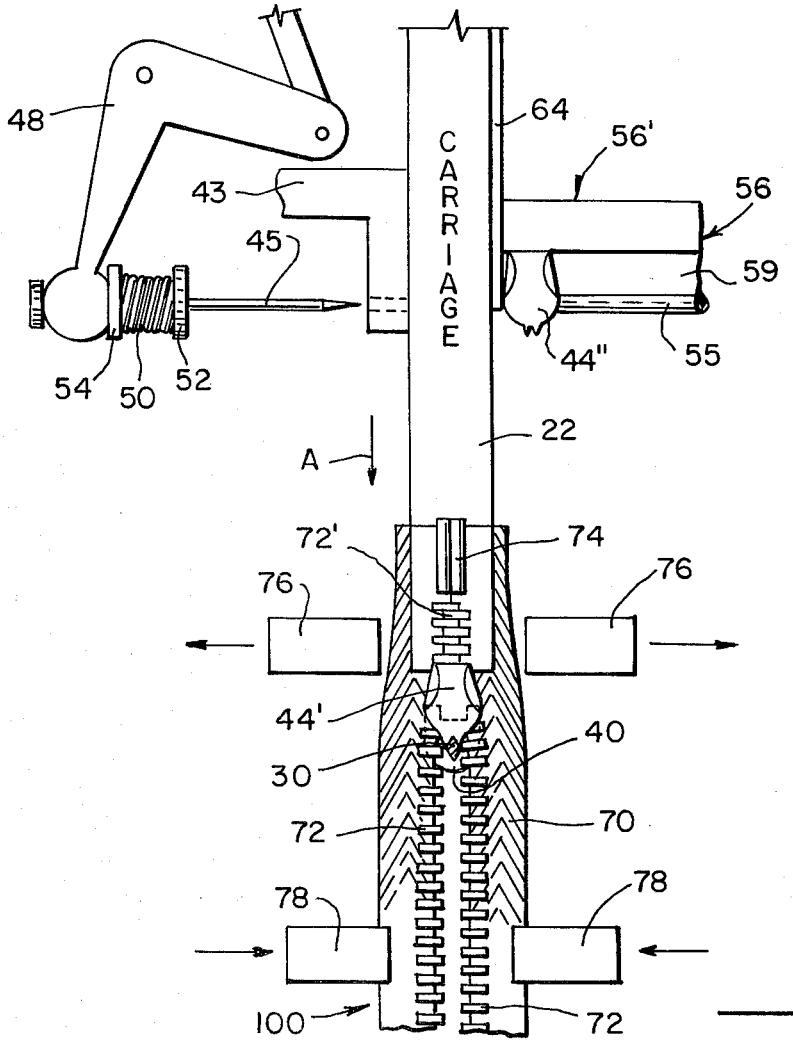
FIG. 11 is a diagrammatic plan view of parts of the mechanism at a fourth stage of the cycle.

FIG. 11 shows a further stage in the operation cycle. The carriage 22 has moved further forwardly toward the chains 70, still carrying the slider 44'.

Terminal tips 74 have passed through the slider 44' due to movement of the carriage 22, and the following teeth 72' of the chains 70 have become mutually engaged as they pass through the slider 44' clamped by the foot 40. Those teeth which have not yet passed to the foot 40 are not engaged with each other. The carriage 22 continues to advance in the direction of arrow A until a predetermined length of chains 70 is closed by slider 44'. Then the lever 30 is pivoted and the foot 40 releases the slider 44', and the carriage 22 retracts. Also the jaws 76 release the slide fastener chains 70 while a pair of jaws 78 located rearwardly of the jaws 76 grasp the new slide fastener assembly 100 and move it to another station where a covering or box is placed over the terminal tips 74. At the same time the lever 30 is pivoted, the pin 45 is released and advances under spring bias to again enter the tube 55 at the track 56. Simultaneously stop bar 64 is cammed up to release the slider 44" which moves to the position of the slider 44' to engage on the pin 45 off of the track 56. The operation cycle described above then repeats.

The control system which automatically actuates carriage 22, motors 26, 38, 46, 77 has not been described herein because it is considered largely a matter of design and beyond the scope of the present invention as described and claimed herein.

Figure 12:
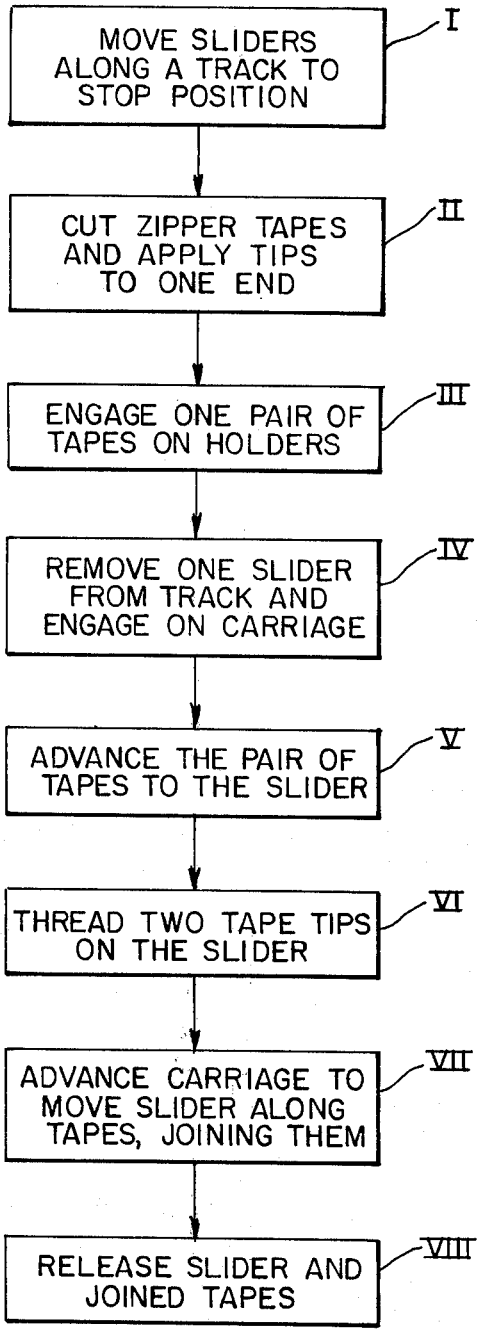
FIG. 12 is a flow chart of the method used according to the invention in engaging a slider on a pair of slide fastener chains.

FIG. 12 is a flow chart outlining the several steps in the operating cycle. At step I, the sliders 44 feed from the hopper 60 pass down the track 56 and stopped by the pin 45. At step II, slide fastener chains 70 are cut to predetermined length and tips are applied to one end of each. At step III, one pair of chains is engaged by the holding jaws 76 with tipped ends extending forwardly. At step IV, one slider 44' is engaged by the foot 40 against the anvil 42 of the carriage 22. At step V, the pair of chains held by the jaws 76 advances toward the slider 44' held by the carriage 22 and at step VI, the two chain tips 74 are threaded through the slider 44'. At step VII, the carriage advances with the slider 44 to close a predetermined length of the slide fastener assembly. At step VIII, the slide fastener assembly is released and engaged by other jaws which convey the slide fastener assembly to another station for further processing.

Although the aforedescribed apparatus and method describe cutting sliderfastener chains to a predetermined length and applying tips to one end thereof before insertion into a slide, it is obvious that the chains may be endless and may be cut to length after the slider is installed. Moreover, it should be understood that it is not essential for tips to be applied at one end of each of the chains, inasmuch as the chains are conventional and the ends thereof have conventional teeth and beading which makes them rigid enough to be inserted into the slider without tips. It should be further understood that it is within the scope of this invention that:

(1) The slider and chains both move toward one another as the ends thereof are automatically inserted into the slider, or (2) The slider be stationary and the chains with the free ends move toward the slider and be automatically inserted therethrough.

It should be understood that the foregoing relates to only a preferred embodiment of the invention, and that it is intended to cover all changes and modifications of the example of the invention herein chosen for the purposes of the disclosure, which do not constitute departures from the spirit and scope of the invention.

The invention claimed is:

1. A mechanism for assembling a slider with a pair of slide fastener tapes having chains of teeth thereon, comprising:

a carrier;

a clamping member pivotally carried by said carrier and arranged in cooperation with said carrier to hold one slider in position to be threaded on a pair of slide fastener tapes;

a movable support for a pair of said tapes arranged to present one end of said pair of tapes to said carrier; and first motive means for moving said support so that said end of said pair of tapes simultaneously enter a slider held by said carrier and said clamping member.

2. A mechanism as defined in claim 1, further including a second motive means for advancing said carrier, so that teeth of adjacent tapes mesh with each other as said tapes pass through said slider.

3. A mechanism as defined in claim 1, further comprising means to feed one slider at a time to said carrier said feeding means comprising:

a hopper containing a plurality of sliders;

a track connected to said hopper for conveying a single file of sliders to said carriage;

a retractable slider support means arranged to engage the first slider from said hopper; and a movable stop member on said carriage arranged to hold said sliders on said track when said slider support means are retracted.

4. A mechanism as defined in claim 3, further comprising third motive means arranged to pivot said clamping member for engaging a single slider between said clamping member and said carrier; and fourth motive means arranged to retract said slider support means from said slider when said slider is engaged by said clamping member.

5. A mechanism as defined in claim 1, wherein said movable support comprises a movable jaw arranged to engage marginal edges of each one of said pairs of tapes, and further arranged to move an engaged pair of tapes toward said carrier with free ends of said engaged tapes projecting toward said carrier.

6. A mechanism as defined in claim 4, further comprising a stationary base block movably supporting said carrier.

7. A mechanism as defined in claim 6, further comprising a bias means on said slider support means arranged to advance said slider support means to engage said first slider; and linkage means interposed between said slider support means and said first motor means for releasing said single slider when engaged by said clamping member.

8. A mechanism as defined in claim 7, further comprising a vibrator means operatively arranged to shake said sliders on said track and keep them moving along said track from said hopper to said carrier.

9. A mechanism as defined in claim 8 further comprising means to feed one slider at a time to said carrier said feeding means comprising:

a hopper containing a plurality of sliders;

a track connected to said hopper for conveying a single file of sliders to said carriage;

a retractable slider support means arranged to engage the first slider from said hopper; and a movable stop member on said carriage arranged to hold said sliders on said track when said slider support means are retracted.

10. A mechanism as defined in claim 2, comprising fifth motive means arranged to lift and lower said stop member cyclically, so that said remaining sliders are retained on said track by said stop member when said slider support means are retracted.

* * * * *